US008188966B2

(12) United States Patent
Choi

(10) Patent No.: US 8,188,966 B2
(45) Date of Patent: May 29, 2012

(54) IMAGE DISPLAY DEVICE AND METHOD CAPABLE OF ADJUSTING BRIGHTNESS

(75) Inventor: Yong Seok Choi, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 702 days.

(21) Appl. No.: 12/232,351

(22) Filed: Sep. 16, 2008

(65) Prior Publication Data

US 2009/0128583 A1 May 21, 2009

(30) Foreign Application Priority Data

Nov. 17, 2007 (KR) ..... 10-2007-0094315

(51) Int. Cl.
*G09G 5/10* (2006.01)

(52) U.S. Cl. ..... 345/102; 345/617

(58) Field of Classification Search ..... 345/102, 345/690, 617
See application file for complete search history.

(56) References Cited

U.S. PATENT DOCUMENTS

| | | | | |
|---|---|---|---|---|
| 7,342,607 | B2 * | 3/2008 | Liu | 382/167 |
| 2003/0038952 | A1 * | 2/2003 | Matsukubo et al. | 382/269 |
| 2004/0257329 | A1 | 12/2004 | Park et al. | |
| 2008/0094346 | A1 | 4/2008 | De Greef | |
| 2008/0224977 | A1 | 9/2008 | Park et al. | |
| 2009/0002400 | A1 * | 1/2009 | Ha et al. | 345/102 |

FOREIGN PATENT DOCUMENTS

WO WO 2005/109391 11/2005

OTHER PUBLICATIONS

European Search Report issued in EP 08 16 4517, mailed Ocotber 5, 2009.

"Multiplication Par Decalage de Bits", http://www.developpez.net/forums/d50330/autres-langages/assembleur/multiplication-decalage-bits/, 2005, XP002548766, printed Oct. 5, 2009.

* cited by examiner

*Primary Examiner* — Chanh Nguyen
*Assistant Examiner* — Allison Walthall
(74) *Attorney, Agent, or Firm* — NSIP Law

(57) ABSTRACT

Provided is an image display device capable of adjusting brightness. The image display device includes a brightness determining unit that determines the brightness of image data, applied from outside, so as to output a backlight selection signal and a contrast selection signal; a backlight control unit that is connected to the brightness determining unit and outputs a backlight driving voltage for supplying backlight with brightness corresponding to the backlight selection signal; a contrast control unit that is connected to the brightness determining unit and outputs an image output signal for outputting an image of which the contrast is adjusted to correspond to the contrast selection signal; and an image display unit that is connected to the backlight control unit and the contrast control unit and receives the backlight driving voltage and the image output signal so as to display an image in which the brightness of the backlight and the contrast of the image data are respectively adjusted.

22 Claims, 7 Drawing Sheets

[FIG. 1] [RELATED ART]
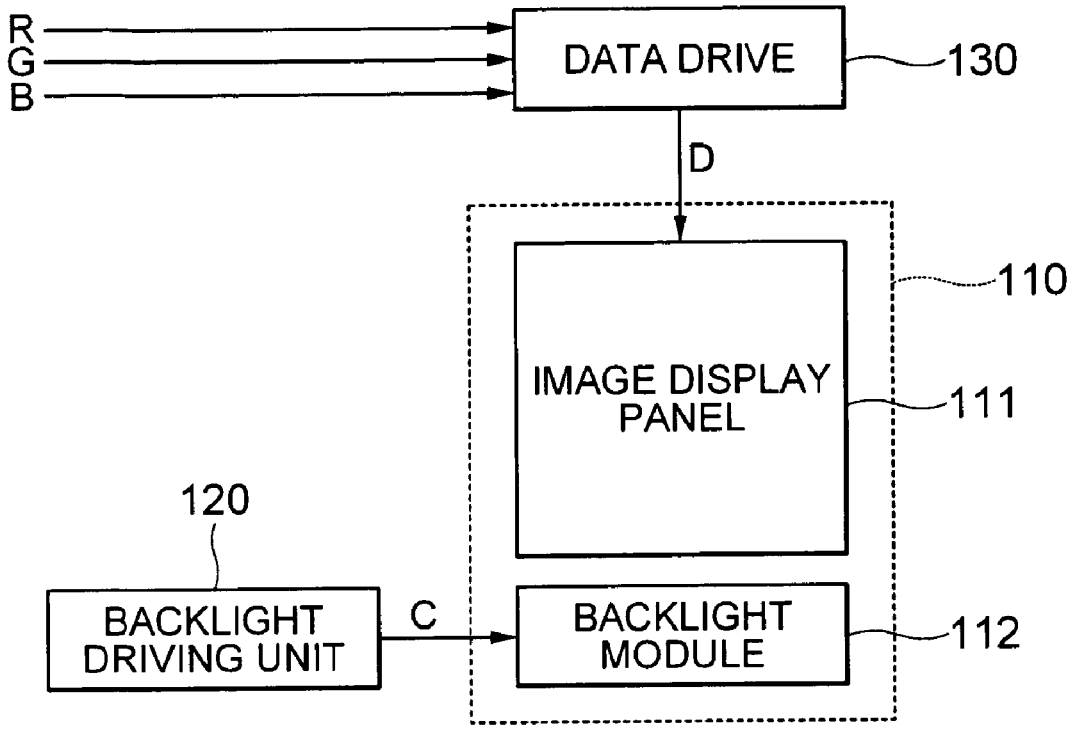

[FIG. 2]
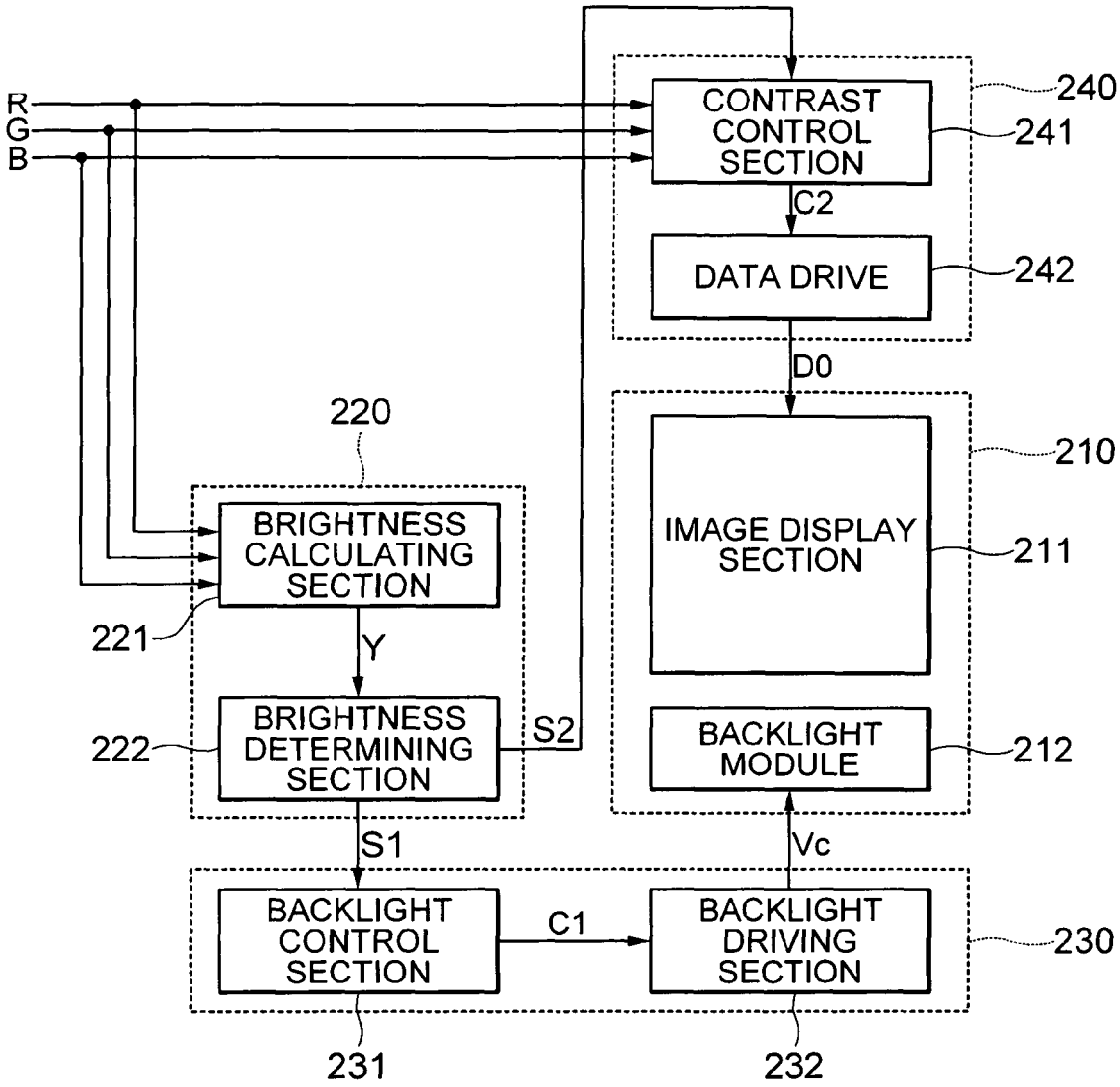
[FIG. 3]
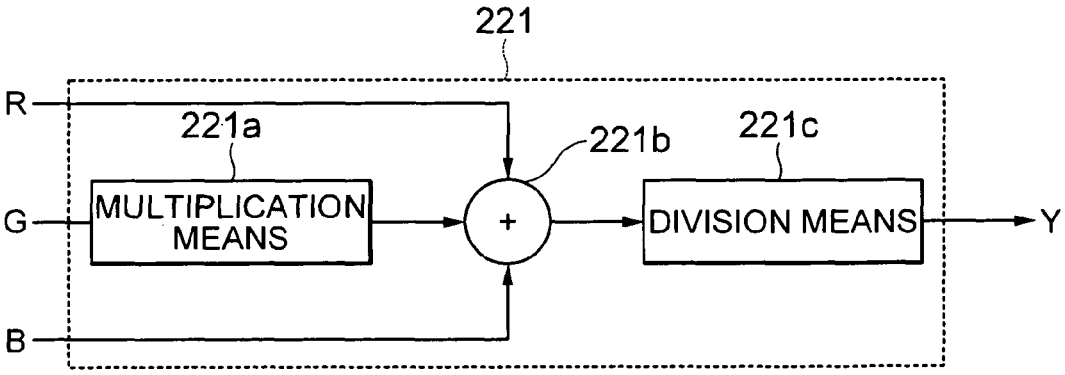

[FIG. 4]
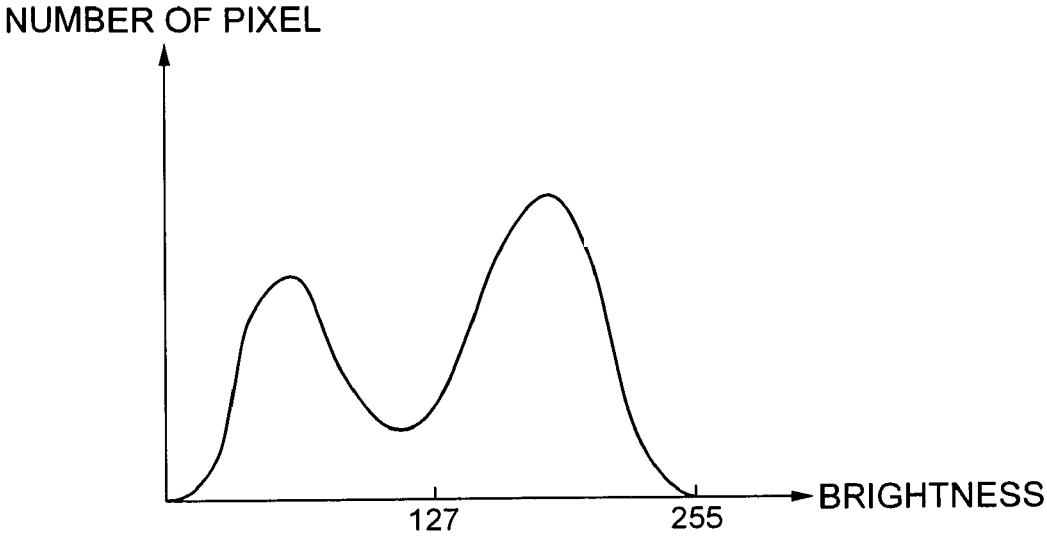
[FIG. 5]
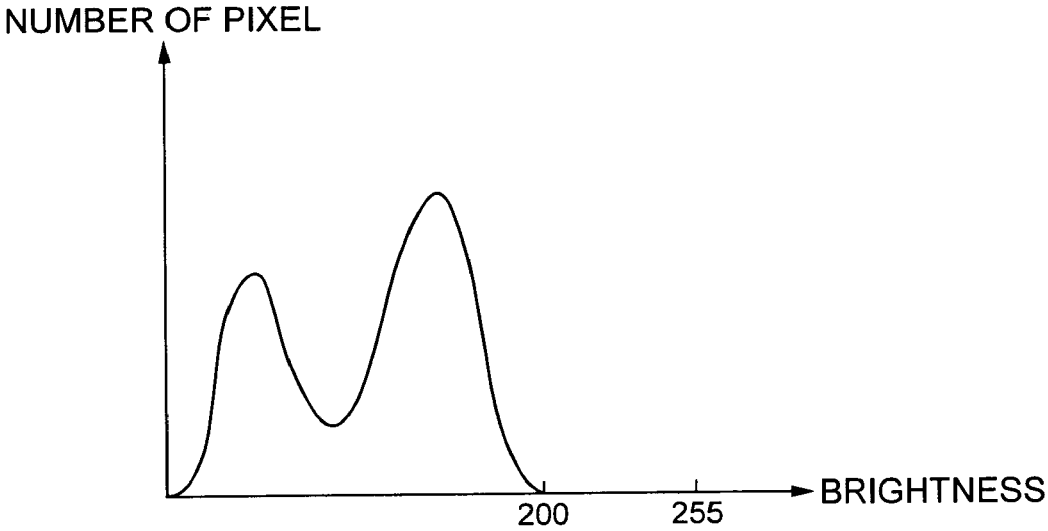

[FIG. 6]
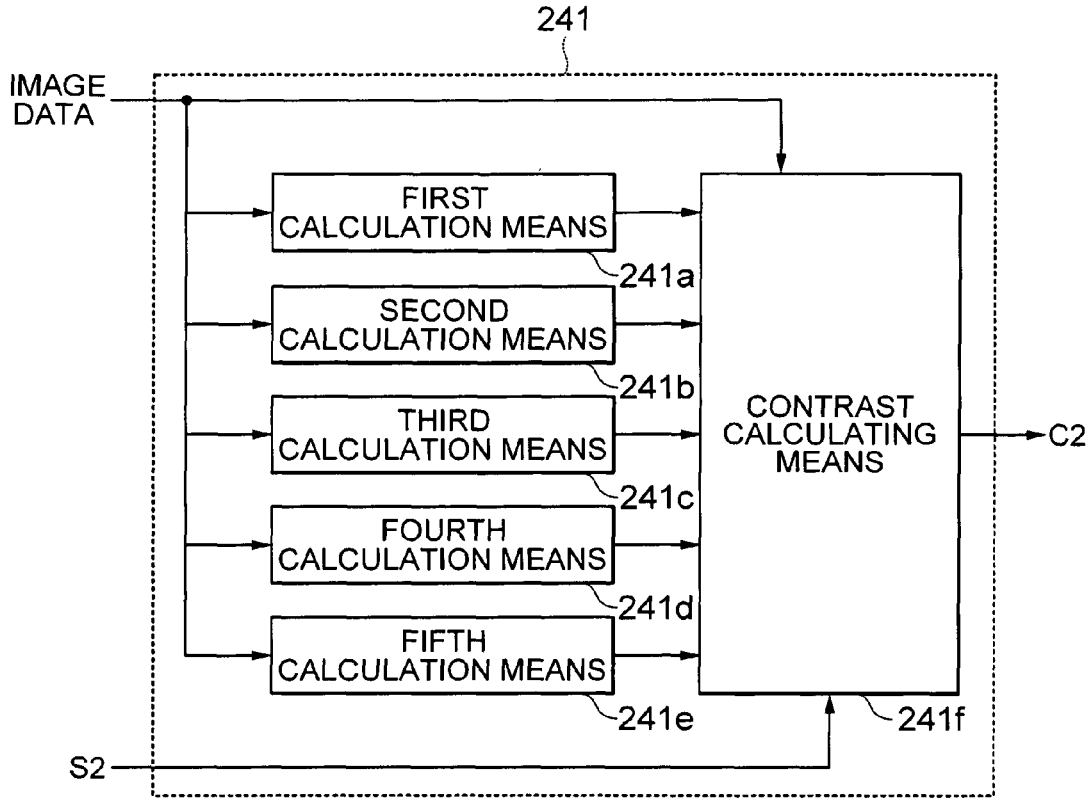
[FIG. 7A]
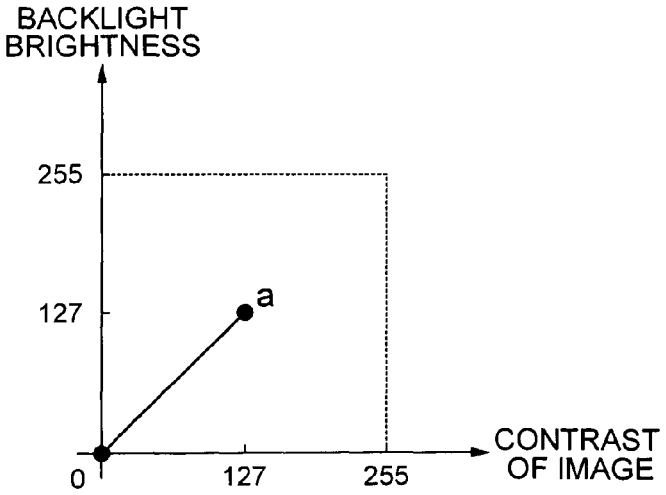

[FIG. 7B]
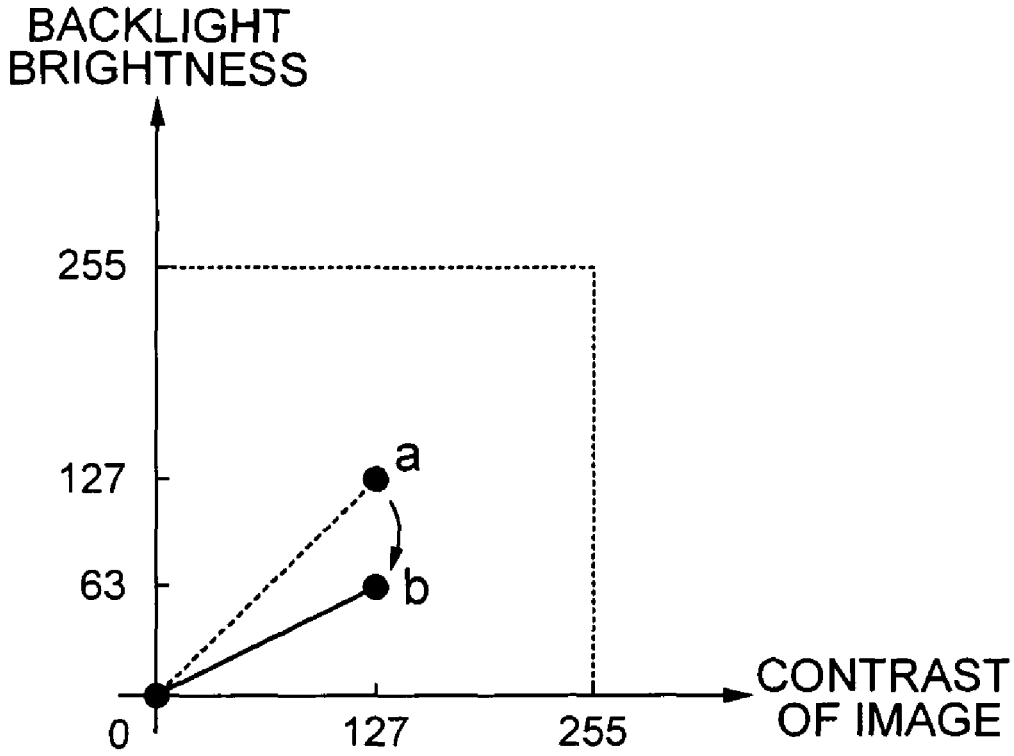
[FIG. 7C]
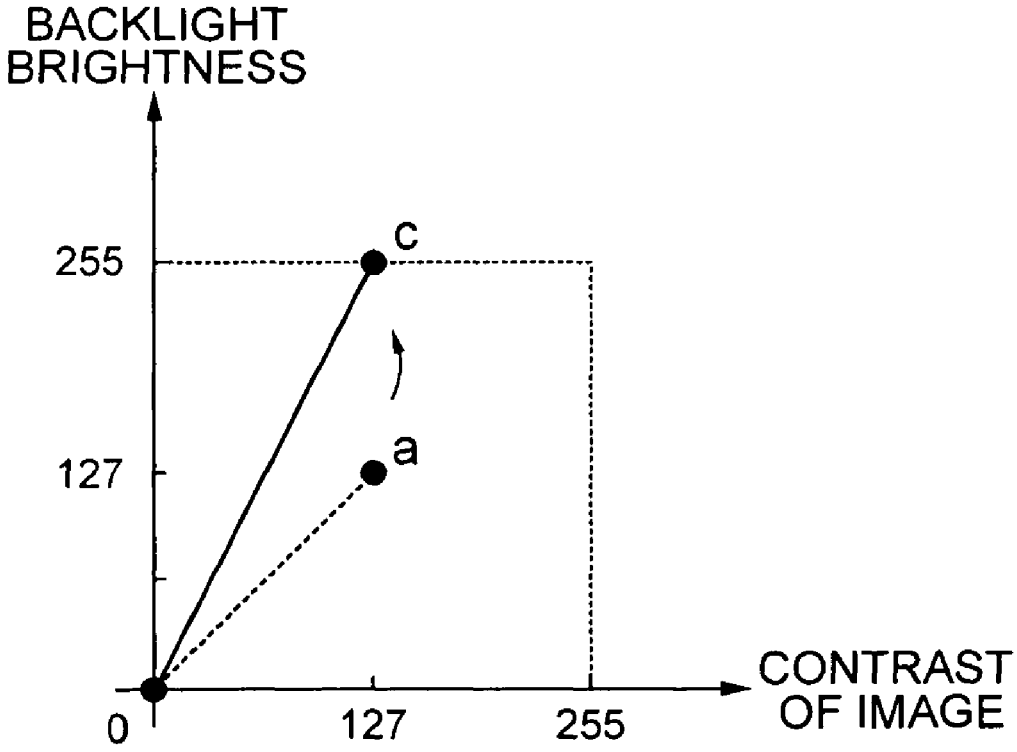

[FIG. 7D]
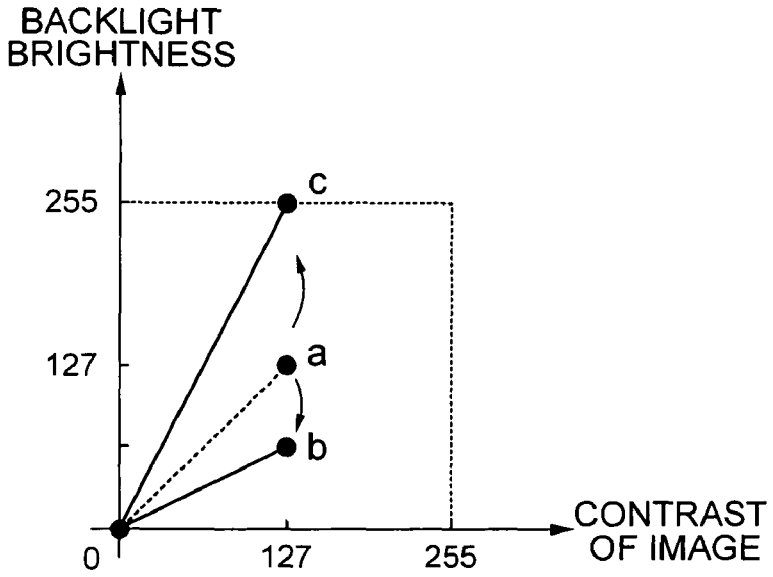
[FIG. 8]
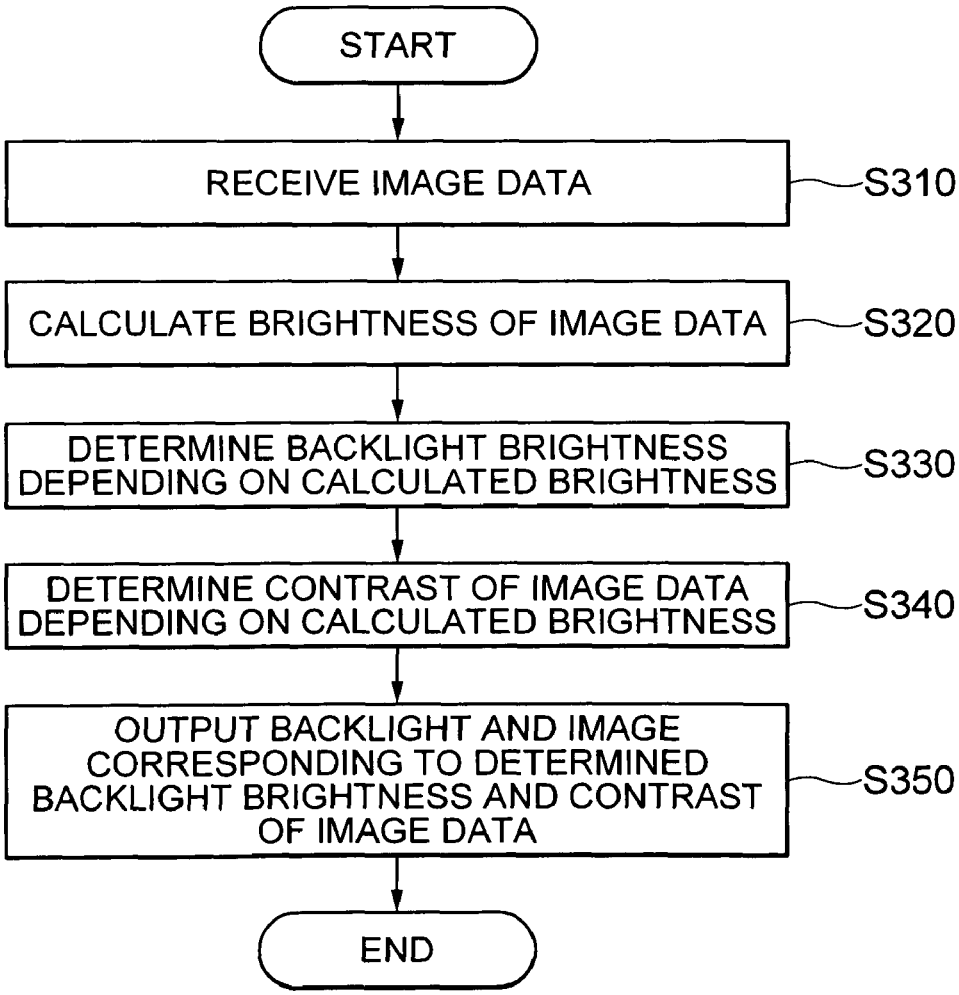

[FIG. 9]
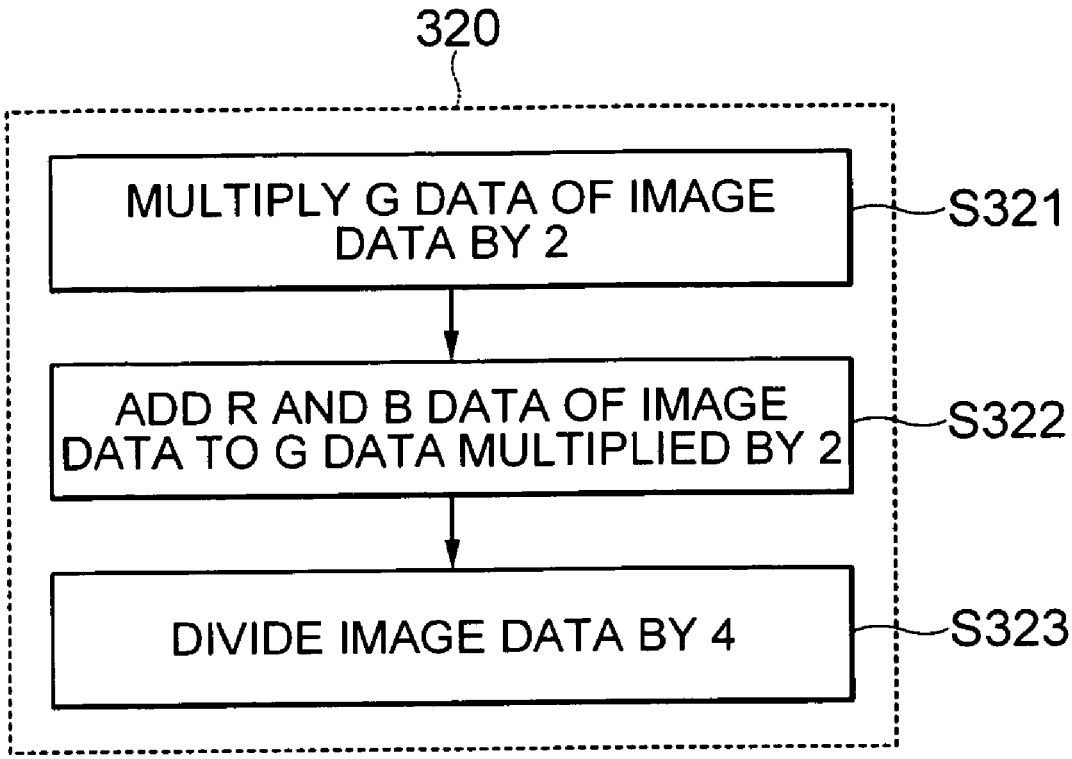

IMAGE DISPLAY DEVICE AND METHOD CAPABLE OF ADJUSTING BRIGHTNESS

CROSS-REFERENCE TO RELATED APPLICATIONS

This application claims the benefit of Korean Patent Application No. 10-2007-0094315 filed with the Korea Intellectual Property Office on Nov. 17, 2007, the disclosure of which is incorporated herein by reference.

BACKGROUND OF THE INVENTION

1. Field of the Invention

The following description relates to an image display device and method capable of adjusting brightness.

2. Description of the Related Art

In general, image display devices serve to display image data, applied from a camera or imaging device, in a state of visible light which can be seen by people. Televisions or beam projectors belong to the image display devices. Recently, with the development of technology, researches on image display devices using LCD (Liquid Crystal Display) or PDP (Plasma Display Panel) are actively carried out.

In particular, since the LCD cannot emit light by itself, an image display device using the LCD requires a separate light source for LCD. As for the light source for LCD, a CCFL (Cold Cathode Fluorescent Lamp) is mainly used. In terms of characteristics of the CCFL, the brightness and lifespan thereof are inversely proportional to each other. That is, when the CCFL is driven by a high current so as to increase the brightness, the lifespan is reduced. On the contrary, to increase the lifespan, the CCFL should be driven by a low current. Therefore, it is difficult to achieve high brightness. In most cases, however, high brightness and a long lifespan are simultaneously requested, when the CCFL is applied to products.

Hereinafter, a conventional image display device using the LCD panel will be described with reference to accompanying drawings.

FIG. 1 is a block diagram of a conventional image display device.

As shown in FIG. 1, the conventional image display device includes an image display unit 110, a backlight driving unit 120, and a data drive 130.

The image display unit 110 is composed of an image display panel 111 and a backlight module 112 and is connected to the backlight driving unit 120 and the data drive 130. The image display unit 110 outputs image output data D, applied through the data drive 130, through the image display panel 111.

The backlight driving unit 120 generates a driving voltage C for driving the backlight module 112 so as to supply to the backlight module 112. The backlight module 112 is driven by the driving voltage C supplied from the backlight driving unit 120 so as to supply light to the image display panel 111 while maintaining constant brightness.

The data drive 130 delivers to the image display panel 111 the image output data D which is converted into data for outputting RGB image data applied from outside through the image display panel 111.

That is, to output the RGB image data, applied from outside, as visible light which can be seen by people, the image output data D converted by the data drive 130 is delivered to the image display panel 111. Further, to supply auxiliary light to the image display panel 111 which cannot emit light, the driving voltage C supplied through the backlight driving unit 120 is supplied to the backlight module 112 such that the RGB image data is displayed on the image display panel 111.

However, the conventional image display device has the following problems.

In the conventional image display device, a technique for high brightness and long-term lifespan is adopted, in which when an image should be displayed with high brightness or an external input is received from a user while the backlight module 112 is driven so as to display an image on the image display panel 111 with preset brightness, a high current is temporarily applied to the backlight module 112 such that an active region of the image display panel 111 with respect to the brightness is widened.

Further, when the image display panel 111 is used as the LCD, an amount of current used in the image display panel 111 differs depending on an image displayed on the image display panel 111. That is, in a case of the normally-white mode where liquid crystal molecules within the image display panel 111 are re-arranged in an electric-field direction with the application of voltage to the image display panel 111 such that incident light is cut off, the power consumption of the image display panel 111 is reduced, as the number of bright pixels increases in the image display panel 111. However, as the number of dark pixels increases, the power consumption of the image display unit 110 is increased.

To solve such a problem, a method is used in which a current value of the driving voltage C of the backlight module 112 interlocked with the image display panel 111 is controlled depending on the power consumption of the image display panel 111. When such a method is applied, an additional circuit should be implemented in such a manner that the conventional image display device fits into a variable range for controlling the brightness of the backlight driving unit 120 which detects the current consumed by the image display panel 111 and drives the backlight module 112.

Further, since all the images are controlled with the same brightness, power consumption increases in comparison with when the brightness should be controlled only for an image where the brightness control is required. As the brightness is adjusted, a brighter or darker image than an intended image may be output. Then, reliability of the image is degraded.

SUMMARY OF THE INVENTION

A general aspect may provide an image display device and a method capable of adjusting brightness that simultaneously adjusts the brightness of backlight and the contrast of an image depending on image data output to the image display device such that power consumption of a backlight module and the brightness are adjusted. Therefore, it is possible to reduce the power consumption.

According to a general aspect, an image display device capable of adjusting brightness includes a brightness determining unit that determines the brightness of image data, applied from outside, so as to output a backlight selection signal and a contrast selection signal; a backlight control unit that is connected to the brightness determining unit and outputs a backlight driving voltage for supplying backlight with brightness corresponding to the backlight selection signal; a contrast control unit that is connected to the brightness determining unit and outputs an image output signal for outputting an image of which the contrast is adjusted to correspond to the contrast selection signal; and an image display unit that is connected to the backlight control unit and the contrast control unit and receives the backlight driving voltage and the image output signal so as to display an image in which the brightness of the backlight and the contrast of the image data are respectively adjusted.

The general aspect of the image display device may further provide that the image data applied from outside is RGB data.

The general aspect of the image display device may further provide that the brightness determining unit includes a brightness calculating section which calculates the brightness of the applied image data; and a brightness determining section which outputs a backlight selection signal and a contrast selection signal corresponding to the brightness calculated by the brightness calculating section. Further, the general aspect of the image display device may provide that the brightness calculating section includes a multiplication means which multiplies G data of the image data by 2; an addition means which adds R and G data of the image data to the G data calculated by the multiplication means; and a division means which divides the image data, calculated by the addition means, by 4.

The general aspect of the image display device may further provide that the multiplication means shifts the G data by one bit in the left direction so as to multiply the G data by 2. Further, the general aspect of the image display device may provide that the division means shifts the image data, calculated by the addition means, by two bits in the right direction so as to divide the image data by 4.

The general aspect of the image display device may further provide that when the backlight selection signal is a signal for supplying backlight with brightness lower than a reference backlight selection signal, the brightness determining section outputs a contrast selection signal for outputting an image of which the contrast is higher than a reference contrast selection signal.

The general aspect of the image display device may further provide that the backlight control unit includes a backlight control section which receives the backlight selection signal output from the brightness determining unit so as to output a backlight control signal for adjusting backlight; and a backlight driving section which is connected to the backlight control section and is controlled by the backlight control signal output from the backlight control section so as to supply a backlight driving voltage to the image display unit. Further, the general aspect of the image display device may provide that the backlight control section controls the backlight driving voltage through a PWM (Pulse Width Modulation), PAM (Pulse Amplitude Modulation), or PFM (Pulse Frequency Modulation) control method, and the backlight driving section controls the voltage or current of the backlight driving voltage.

The general aspect of the image display device may further provide that the contrast control unit includes a contrast control section which is connected to the brightness determining unit, receives the contrast selection signal output from the brightness determining unit, and adjust the contrast of image data so as to output an image signal of which the contrast is adjusted; and a data drive which is connected to the contrast control section and the image display unit and receives the image signal output from the contrast control section so as to output an image output signal for outputting an image with contrast corresponding to the image signal.

The general aspect of the image display device may further provide that the contrast control section includes first to fifth calculation means which shift the image data, applied from outside, by one bit, two bits, three bits, four bits, and five bits, respectively; and a contrast calculating means which is connected to the first to fifth calculation means and the brightness determining unit and selectively adds the image data output from the first to fifth calculation means depending on preset backlight brightness combinations such that the contrast of the image data corresponds to the contrast selection signal output from the brightness determining unit, thereby generating an image signal of which the contrast is adjusted.

The general aspect of the image display device may further provide that the image display unit includes an image display section which is connected to the contrast control unit and receives the image output signal output from the contrast control unit so as to output an image; and a backlight module which is disposed on the rear surface of the image display section, is connected to the backlight control unit, and receives the backlight driving voltage supplied from the backlight control unit so as to supply backlight to the image display section. Further, the general aspect of the image display device may provide that image data applied from outside is converted into any one color coordinate selected from YUV, YCbCr, and YCoCg so as to adjust brightness.

According to another general aspect, an image display method capable of adjusting brightness includes the steps of: (a) calculating the brightness of image data applied from outside; (b) determining the brightness of backlight corresponding to the calculated brightness; (c) determining the contrast of the image data corresponding to the calculated brightness; and (d) outputting backlight and an image corresponding to the determined brightness of the backlight and the determined contrast of the image data, respectively.

The general aspect of the image display method may further provide that the image data applied from outside is RGB data. Further, the general aspect of the image display method may provide that the calculating of the brightness includes the steps of: (a-1) multiplying G data of the image data by 2; (a-2) adding R and B data of the image data to the G data multiplied by 2 in step (a-1); and (a-3) dividing the image data calculated in step (a-2) by 4.

The general aspect of the image display method may further provide that the multiplying of the G data is performed by shifting the G data by one bit in the left direction, and the dividing of the image data is performed by shifting the image data by two bits in the right direction.

The general aspect of the image display method may further provide that when the backlight brightness determined in step (b) is lower than reference backlight brightness, it is judged in step (c), that the contrast of the image data is higher than that of reference image data. Further, the general aspect of the image display method may provide that controlling the backlight brightness in step (d) is performed by controlling the voltage or current of a driving voltage for driving a backlight module of an image display device which outputs image data.

The general aspect of the image display method may further provide that the voltage or current of the driving voltage supplied to the backlight module is controlled by any one control method selected from PWM, PAM, and PFM control methods.

The general aspect of the image display method may further provide that in step (c), the image data is multiplied by a plurality of preset values, respectively, and the calculated values are selectively added depending on preset backlight brightness combinations, thereby adjusting the contrast of the image data.

The general aspect of the image display method may further provide that when the image data is multiplied by the plurality of preset values, respectively, the received image data is shifted by one bit, two bits, three bits, four bits, and five bits in the left direction.

The general aspect of the image display method may further provide that the image data applied from outside is converted into any one color coordinate selected from YUV, YCbCr, and YCoCg so as to adjust brightness.

BRIEF DESCRIPTION OF THE DRAWINGS

Other features and aspects may be apparent from the following detailed description, the drawings, and the claims.

FIG. 1 is a block diagram of a conventional image display device;

FIG. 2 is a schematic block diagram illustrating an example of an image display device according to a general aspect;

FIG. 3 is a block diagram illustrating an example of a brightness calculating section of the image display device according to a general aspect;

FIGS. 4 and 5 are graphs illustrating examples that show the brightness of image data of the image display device according to a general aspect;

FIG. 6 is a block diagram illustrating an example of a contrast control section of the image display device according to a general aspect;

FIGS. 7A to 7D are graphs illustrating examples that show images which are output in accordance with the contrast of image data and the backlight brightness of the image display device according to a general aspect;

FIG. 8 is a flow chart illustrating an example that sequentially shows an image display method according to another general aspect; and FIG. 9 is a flow chart illustrating an example that sequentially shows a process of calculating the brightness of image data in the image display method according to another general aspect.

DETAILED DESCRIPTION

Reference will now be made in detail to examples of general aspects, illustrated in the accompanying drawings, where like reference numerals refer to like elements throughout. Examples are described below in order to explain general aspects by referring to the figures.

Image Display Device

Hereinafter, an example of an image display device capable of adjusting brightness according to general aspect will be described in detail with reference to the accompanying drawings.

FIG. 2 is a schematic block diagram illustrating an example of an image display device according to general aspect. FIG. 3 is a block diagram illustrating an example of a brightness calculating section of the image display device according to a general aspect. FIGS. 4 and 5 are graphs illustrating examples that show the brightness of image data of the image display device according to a general aspect. FIG. 6 is a block diagram illustrating an example of a contrast control section of the image display device according to a general aspect. FIGS. 7A to 7D are graphs illustrating examples that show images which are output in accordance with the contrast of image data and the backlight brightness of the image display device according to a general aspect.

As shown in FIG. 2, the image display device capable of adjusting brightness according to a general aspect includes an image display unit 210, a brightness determining unit 220, a backlight control unit 230, and a contrast control unit 240. The image display device displays RGB image data, applied from outside, as visible light through the image display unit 210.

The brightness determining unit 220 is composed of a brightness calculating section 221 and a brightness determining section 222 and is connected to the backlight control unit 230 and the contrast control unit 240. The brightness determining unit 220 determines the brightness of RGB image data applied from outside and then generates a backlight selection signal S1 and a contrast selection signal S2 to deliver to the backlight control unit 230 and the contrast control unit 240, respectively.

As shown in FIG. 3, the brightness calculating section 221 includes a multiplication means 221*a*, an addition means 221*b*, and a division means 221*c*. The brightness calculating section 221 is connected to the brightness determining section 222 and calculates the brightness Y of the applied RGB image data.

The calculating of the brightness Y of the RGB image data is performed by multiplying the G data of the applied RGB image data by 2 through the multiplication means 221*a*. At this time, the multiplying of the G data by 2 is performed by shifting the G data with a constant number of bits by one bit in the left direction.

Then, the G data calculated by the multiplication means 221*a* is added to the R and B data of the RGB image data by the addition means 221*b*. Further, the RGB data calculated by the addition means 221*b* is divided by 4 through the division means 221*c* so as to calculate the brightness Y of the RGB data. At this time, the division of the RGB data by the division means 221*c* is performed by shifting the RGB image data, calculated by the addition means 221*b*, by two bits in the right direction.

The brightness Y of the RGB image data calculated by the brightness calculating section 221 is calculated at every frame of the RGB image data. The brightness Y ranges from 0 to 255, as shown in FIG. 4.

The brightness determining section 222 is connected to the brightness calculating section 221, the backlight control unit 230, and the contrast control unit 240 and generates a backlight selection signal S1 and a contrast selection signal S2, which correspond to the brightness Y calculated by the brightness calculating section 221, so as to deliver to the backlight control unit 230 and the contrast control unit 240, respectively.

The process of determining the backlight selection signal S1 and the contrast selection signal S2, which is performed by the brightness determining section 222, will be described with reference to FIG. 5 and Table 1.

TABLE 1

| Brightness of image data | Backlight brightness | Contrast of image |
|---|---|---|
| 240-255 | 100% | Not adjusted |
| 224-239 | 94% | *(17/16) |
| 208-223 | 88% | *(18/16) |
| 192-207 | 82% | *(19/16) |
| 176-191 | 76% | *(20/16) |
| 160-175 | 70% | *(21/16) |
| 144-159 | 64% | *(22/16) |
| 128-143 | 58% | *(23/16) |
| 112-127 | 52% | *(24/16) |

For example, when the brightness Y of the RGB image data calculated by the brightness calculating section 221 is 200 which is smaller than the maximum value of 255, the brightness determining section 222 receives the brightness Y and searches for a range, to which the brightness Y belongs, in the column for the brightness of image data in Table 1. When the brightness Y is 200, it belongs to a range of 192-207 which is a fourth range from the top of Table 1. In this case, the backlight brightness is 82% of reference backlight brightness, and the contrast of the image is 19/16. That is, when the brightness Y of the RGB image data is 200, a backlight selection signal S1 is output so as to supply backlight with brightness corresponding to 82% of reference backlight brightness which is based on when the brightness of the RGB image data is 255. Further, a contrast selection signal S2 for multiplying the RGB image, data applied from outside, by 19/16 on the basis of reference contrast is output. The reference contrast is based on when the brightness Y of the RGB image data is 255.

When the brightness Y of the RGB image data calculated by the brightness calculating section 221 is 158, the backlight selection signal S1 is selected as a signal for supplying backlight with brightness corresponding to 64% of the reference backlight brightness, because the brightness Y of the RGB image data belongs to a range of 144-159 in the column for the brightness of image data in Table 1. Further, the contrast selection signal S2 is selected as a signal for supplying contrast obtained by multiplying the applied RGB image data by 22/16. For example, the selected backlight selection signal Si and contrast selection signal S2 are not generated as a percentage signal and a mathematical signal, as shown in Table 1, but are generated and output as coded signals.

The backlight selection signal S1 and the contrast selection signal S2, selected by the above-described method, are delivered to the backlight control unit 230 and the contrast control unit 240, respectively.

The backlight control unit 230 is composed of a backlight control section 231 and a backlight driving section 232 and generates a backlight driving voltage Vc, corresponding to the backlight selection signal S1 delivered by the brightness determining section 222, to deliver to the image display unit 210.

The backlight control section 231 is connected to the brightness determining section 222 of the brightness determining unit 220 and the backlight driving section 232. To generate a backlight driving voltage Vc corresponding to the backlight selection signal S1 delivered from the brightness determining section 222, the backlight control section 231 generates a backlight control signal C1 for controlling the backlight driving section 232 and then delivers the backlight control signal C1 to the backlight driving section 232.

When the backlight driving section 232 is controlled by the backlight control section 231, the controlling is performed by any one selected from PWM (Pulse Width Modulation), PAM (Pulse Amplitude Modulation), and PFM (Pulse Frequency Modulation) control methods.

The backlight driving section 232 is connected to the backlight control section 231 and the image display unit 210 and receives the backlight control signal C1 output from the backlight control section 231 so as to output a backlight driving voltage Vc controlled by the backlight control signal C1. At this time, the backlight driving section 232 controls the voltage or current of the backlight driving voltage Vc, which is to be output, through the backlight control signal C1, thereby adjusting the magnitude of the backlight driving voltage Vc.

When the backlight selection signal S1 output from the brightness determining section 222 is a signal for emitting backlight brightness corresponding to 82% of the reference backlight brightness, the backlight control section 231 generates a backlight control signal C1 for generating the backlight driving voltage Vc as a driving voltage Vc corresponding to 82% of a reference voltage. The backlight driving section 232 receiving the backlight control signal C1 is controlled by the backlight control signal C1 so as to generate a backlight driving voltage Vc with a magnitude corresponding to 82% of the reference voltage. At this time, when the backlight selection signal S1 output from the brightness determining section 222 is a signal for emitting backlight brightness corresponding to 58% of the reference backlight brightness, the backlight control section 231 generates a backlight control signal C1 for controlling the backlight control section 232. The backlight driving section 232 receiving the backlight control signal C1 is controlled by the backlight control signal C1 so as to generate a backlight driving voltage Vc for emitting backlight brightness corresponding to 58% of the reference backlight brightness. Then, the backlight driving section 232 supplies the backlight driving voltage Vc to the image display unit 210.

The contrast control unit 240 is composed of a contrast control section 241 and a data drive 242 and is connected to the brightness determining section 222 and the image display unit 210. The contrast control unit 240 is controlled by the contrast selection signal S2 delivered from the brightness determining section 222 so as to control the contrast of the RGB image data, thereby delivering to the image display unit 210 an image output signal DO of which the contrast is adjusted.

As shown in FIG. 6, the contrast control section 241 is composed of first to fifth calculation means 241*a* to 241*e* and a contrast calculating means 241*f* and is connected to the brightness determining section 222 and the data drive 242. The contrast control section 241 multiplies the RGB data applied from outside by a selective combination of values calculated by the first to fifth calculation means 241*a* to 241*e*, thereby generating an image signal C2 of which the contrast is adjusted. The combination is selected by the contrast selection signal S2.

The first calculation means 241*a* receives the RGB image data and then divides the RGB image data by 2 to output. At this time, the division in the first calculation means 241*a* is performed by shifting the RGB image data by one bit in the right direction.

Further, the second to fifth calculation means 241*b* to 241*e* receive the RGB image data and then divide the RGB image data by 4, 8, 16, and 32, respectively. At this time, the division in the second to fifth calculation means 241*b* to 241*e* is performed by shifting the RGB image data by two bits, three bits, four bits, and five bits, respectively, in the right direction. The reason why the RGB image data can be divided by shifting the RGB data in the right direction is as follows. Since the RGB image data is composed of binary numbers, a value obtained by shifting data composed of binary numbers by x bits in the right direction is equal to a value obtained by dividing the original data by $2^x$. Further, the reason why the G data of the RGB data is shifted in the left direction when the multiplication is performed by the brightness calculating section 221 is that when data is shifted by x bits in the left direction, a value obtained by multiplying the data by $2^x$ is output.

The contrast calculating means 241*f* is connected to the first to fifth calculation means 241*a* to 241*e*, the brightness determining section 222, and the data drive 242 and receives the values calculated by the first to fifth calculation means 241*a* to 241*e* and the RGB image data. Further, the contrast calculating means 241*f* multiplies the RGB image data by a combination of values corresponding to the contrast selection signal S2 applied from the brightness determining section 222, thereby generating an image signal C2 of which the contrast is adjusted.

At this time, the calculation performed by the contrast calculating means 241*f* is performed as follows. In order to adjust the contrast of an image corresponding to the contrast selection signal S2 selected through Table 1, the values obtained by the division of the first to fifth calculation means 241*a* to 241*e* are selectively combined depending on preset brightness and are multiplied by the RGB image data, thereby generating an image signal where the contrast of the RGB image data is adjusted.

For example, when the contrast selection signal S2 is determined as 17/16 because the brightness Y of the RGB data is 245, the contrast calculating means 242 adds a value obtained by multiplying the value, calculated by the first calculation means 241*a*, by 2 to a value obtained by multiplying the value, calculated by the fourth calculation means 241*d*, by 1. Then, a combination of 17/16 corresponding to the contrast selection signal S2 can be completed.

Further, when the contrast selection signal S2 is determined as 21/16 because the brightness Y of the RGB data is 170, the contrast calculating means 242 adds a value obtained by multiplying the value, calculated by the second calculation means 242*b*, by 2 to a value obtained by multiplying the value, calculated by the fourth calculation means 241*d*, by 1. Then, a combination of 21/16 corresponding to the contrast selection signal S2 can be completed.

The data drive 242 is connected to the contrast control section 241 and the image display unit 210 and receives the image signal C2 generated by the contrast control section 241 so as to convert into an image output signal D0 which is to be displayed to the outside by the image display unit 210.

The image display unit 210 is composed of an image display section 211 and a backlight module 212 and is connected to the backlight control unit 230 and the contrast control unit 240. The image display unit 210 outputs the image output signal D0, delivered from the contrast control unit 230, into a visible-light region by using the backlight driving voltage Vc supplied by the backlight control unit 230.

The image display section 211 is connected to the data drive 242 of the contrast control unit 240 and receives the image output signal D0 output from the data drive 242. Then, the image display section 211 displays the image output signal D0 as visible light so as to output one image.

Further, the backlight module 212 is positioned on the rear surface of the image display section 211 and is connected to the backlight driving section 232 of the backlight control unit 220. The backlight module 212 emits light by using the backlight driving voltage Vc supplied by the backlight driving section 232, thereby supplying backlight as an auxiliary light source to the image display section 211.

FIGS. 7A to 7D are graphs showing images which are output from the image display device in accordance with the backlight brightness and the contrast of image data. Referring to FIGS. 7A to 7D, it can be found that, as backlight brightness at a point 'b' shown in FIG. 7B is set to be lower than that at a point 'a' indicating original data, power consumption to produce the contrast of an image can be reduced. Further, the backlight brightness required to produce the contrast of an image increases from the point 'a' to a point 'c'. That is, as shown in FIG. 7D, the backlight brightness required to produce the contrast of an image is reduced with respect to the image shown in FIG. 7A. Then, the power consumption of the backlight module can be reduced, and the sharpness of the image can be enhanced.

Image Display Method

Hereinafter, an example of an image display method capable of adjusting brightness according to another general aspect will be described with reference to FIGS. 8 and 9.

FIG. 8 is a flow chart illustrating an example that sequentially shows an image display method according to another general aspect. FIG. 9 is a flow chart illustrating an example that sequentially shows a process of calculating the brightness of image data in the image display method according to another general aspect.

The image display method capable of adjusting brightness according to another general aspect is performed as follows. First, as shown in FIG. 8, image data is applied from outside (step S310). The image data is composed of RGB data.

After the image data is applied, the brightness of the image data is calculated (step S320). The process of calculating the brightness of the image data is performed as follows. First, as shown in FIG. 9, G data of the image data is multiplied by 2 (step 321). Then, R and B data of the image data are added to the G data multiplied by 2 in step S321 (step S322). Further, the image data obtained in step S322 is divided by 4 so as to calculate the brightness of the image data (step S323).

When the G data is multiplied by 2 in step S321, the multiplication is performed by shifting the G data applied as binary data by one bit in the left direction. When the image data is divided by 4 in step S323, the division is performed by shifting the image data by two bits in the right direction.

After the brightness of the image data is calculated through step S320, the brightness of backlight is determined in accordance with the calculated brightness (step S330). Further, the contrast of the image data is determined depending on the brightness calculated in step S320 (step S340).

At this time, when the brightness of the backlight determined in the step S330 is lower than reference backlight brightness, it is judged in step S340 that the contrast of the image data is higher than that of reference image data. That is, when the brightness of the backlight is high, the contrast is adjusted into lower contrast. Further, when the brightness of the backlight is low, the contrast is adjusted into higher contrast.

After the brightness of the backlight and the contrast of the image data are determined, backlight and an image corresponding to the brightness of the backlight and the contrast of the image data, respectively, are output (step S350). At this time, in step S350, the brightness of the backlight is adjusted by controlling the voltage or current of a driving voltage for driving a backlight module of the image display device which outputs image data. For example, the controlling of the driving voltage may be performed by any one control method selected from PWM, PAM and PFM control methods, thereby adjusting the brightness of the backlight.

Further, in step 350, the contrast of the image data is adjusted by the following process. First, the image data is divided by a plurality of preset values, respectively. The divided data is then multiplied by a combination of values corresponding to the determining of the brightness. The multiplied values are selectively added depending on preset backlight brightness so as to adjust the contrast of the image data.

For example, when the image data is divided by the plurality of preset values, respectively, the image data is received and is then shifted by one bit, two bits, three bits, four bits, and five bits in the right direction, respectively, so as to perform the multiplication.

According to teachings above, there is provided an image display method which may serve to simultaneously adjust the brightness of the backlight and the contrast of the image data. Therefore, the power consumption of the backlight module may be reduced, and an image may be output more clearly.

Meanwhile, according to teachings above, there is provided an image display device and method which may provide that RGB data is used as the image data. However, the image data is not limited to the RGB data, but can be converted into any one color coordinate selected from YUV, YCbCr, and YCoCg such that the brightness can be adjusted.

A number of examples have been described above. Nevertheless, it will be understood by those skilled in the art that changes may be made. Accordingly, other implementations are within the scope of following claims.

What is claimed is:

1. An image display device capable of adjusting brightness, the image display device comprising:

a brightness determining unit configured to:

receive image data applied from outside;

determine a brightness of the applied image data; and output a backlight selection signal and a contrast selection signal corresponding to the determined brightness of the applied image data;

a backlight control unit that is connected to the brightness determining unit, the backlight control unit being configured to:

receive the backlight selection signal; and output a backlight driving voltage for supplying backlight with a brightness corresponding to the backlight selection signal;

a contrast control unit that is connected to the brightness determining unit, the contrast control unit being configured to receive the applied image data and the contrast selection signal from the brightness determining unit, and output an image output signal, the image output signal being converted from an image signal including the applied image data of which the contrast is adjusted by the contrast control unit to correspond to the contrast selection signal, the contrast control unit comprising:

first to fifth calculation means that shift the applied image data by one bit, two bits, three bits, four bits, and five bits, respectively; and a contrast calculating means that is connected to the first to fifth calculation means and the brightness determining unit, the contrast calculating means being configured to selectively add the image data output from the first to fifth calculation means depending on preset backlight brightness combinations such that a contrast of the image data corresponds to the contrast selection signal output from the brightness determining unit, thereby generating the image signal of which the contrast is adjusted; and an image display unit that is connected to the backlight control unit and the contrast control unit, the image display unit being configured to:

receive the backlight driving voltage and the image output signal; and display an image in which the brightness of the backlight and the contrast of the applied image data are respectively adjusted.

2. The image display device according to claim 1, wherein the applied image data is RGB data.

3. The image display device according to claim 2, wherein the brightness determining unit comprises:

a brightness calculating section configured to calculate the brightness of the applied image data; and a brightness determining section configured to:

determine the brightness of the applied image data using the calculated brightness; and output the backlight selection signal and the contrast selection signal corresponding to the determined brightness.

4. The image display device according to claim 3, wherein the brightness calculating section comprises:

a multiplication means which multiplies G data of the image data by 2;

an addition means which adds R and B data of the image data to the G data calculated by the multiplication means; and a division means which divides the image data, calculated by the addition means, by 4.

5. The image display device according to claim 4, wherein the multiplication means shifts the G data by one bit in the left direction so as to multiply the G data by 2.

6. The image display, device according to claim 4, wherein the division means shifts the image data, calculated by the addition means, by two bits in the right direction so as to divide the image data by 4.

7. The image display device according to claim 3, wherein, when the backlight selection signal is output so as to supply the backlight with a brightness less than a reference backlight selection signal, the brightness determining section the contrast selection signal is output from the brightness determining section so as to display the image in which the contrast is greater than a reference contrast selection signal.

8. The image display device according to claim 1, wherein the backlight control unit comprises:

a backlight control section configured to receive the backlight selection signal output from the brightness determining unit so as to output a backlight control signal for adjusting backlight; and a backlight driving section which is connected to the backlight control section and is controlled by the backlight control signal output from the backlight control section so as to supply the backlight driving voltage to the image display unit.

9. The image display device according to claim 8, wherein the backlight control section controls the backlight driving voltage through a PWM (Pulse Width Modulation), PAM (Pulse Amplitude Modulation), or PFM (Pulse Frequency Modulation) control method.

10. The image display device according to claim 9, wherein the backlight driving section controls the voltage or current of the backlight driving voltage.

11. The image display device according to claim 2, wherein the contrast control unit further comprises:

a contrast control section which is connected to the brightness determining unit and comprises the first to fifth calculation means and the contrast calculation means, the contrast control section being configured to:

receive the contrast selection signal output from the brightness determining unit; and generate and output the image signal in which the contrast of the applied image data is adjusted corresponding to the contrast selection signal; and a data drive which is connected to the contrast control section and the image display unit, the data drive being configured to:

receive the generated and outputted image signal from the contrast control section;

convert the received image signal into the image output signal; and output the image output signal to the image display unit for display, the image output signal including the applied image data of which the contrast is adjusted to correspond to the image signal.

12. The image display device according to claim 1, wherein the image display unit comprises:

an image display section which is connected to the contrast control unit, the image display section being configured to receive the image output signal output from the contrast control unit so as to output the image in which the contrast of the applied image data is adjusted; and a backlight module which is disposed on the rear surface of the image display section and connected to the backlight control unit, the backlight module being configured to receive the backlight driving voltage supplied from the backlight control unit so as to supply backlight to the image display section.

13. The image display device according to claim 1, wherein the applied image data is converted into any one color coordinate selected from YUV, YCbCr, and YCoCg so as to adjust brightness.

14. An image display method capable of adjusting brightness, the image display method comprising:

determining a brightness of image data applied from outside;

determining a brightness of a backlight corresponding to the determined brightness of the applied image data;

determining a contrast of the applied image data corresponding to the determined brightness, the determining of the contrast of the applied image data comprising adjusting the applied image data according to the determined contrast of the applied image data; and outputting the backlight and the adjusted applied image data corresponding to the determined brightness of the backlight and the determined contrast of the applied image data, respectively, wherein:

the determining of the contrast of the applied image data comprises:

dividing the applied image data by a plurality of preset values, respectively;

multiplying the divided applied image data by a combination of values correspondinq to the determined brightness of the applied image data; and selectively adding the multiplied applied image data depending on preset backlight brightness combinations, thereby performing the determining of the contrast of the applied image data; and when the applied image data is divided by the plurality of preset values, respectively, the applied image data is shifted by one bit, two bits, three bits, four bits, and five bits in the right direction.

15. The image display method according to claim 14, wherein the applied image data is RGB data.

16. The image display method according to claim 15, wherein the determining of the brightness of the applied image data comprises calculating the brightness of the applied image data, the calculating of the brightness of the applied image data comprising:

multiplying G data of the applied image data by 2;

adding R and B data of the applied image data to the multiplied G data; and dividing the added R, B, and G data by 4.

17. The image display method according to claim 16, wherein the multiplying of the G data comprises shifting the G data by one bit in the left direction.

18. The image display method according to claim 16, wherein the dividing of the added R, B, and G data comprises shifting the added R, B, and G data by two bits in the right direction.

19. The image display method according to claim 14, wherein, when the determined brightness of the backlight is less than a reference backlight brightness, the determined contrast of the applied image data is greater than that of a contrast of reference image data.

20. The image display method according to claim 14, wherein outputting of the backlight corresponding to the determined brightness of the backlight comprises controlling a voltage or current of a driving voltage for driving a backlight module of an image display device which outputs image data.

21. The image display method according to claim 20, wherein the voltage or current of the driving voltage supplied to the backlight module is controlled by one of a PWM (Pulse Width Modulation), PAM (Pulse Amplitude Modulation), and PFM (Pulse Frequency Modulation) control method.

22. The image display method according to claim 14, wherein the applied image data is converted into one of YUV, YCbCr, and YCoCg color coordinates so as to adjust the brightness of the applied image data.

* * * * *

UNITED STATES PATENT AND TRADEMARK OFFICE

CERTIFICATE OF CORRECTION

PATENT NO. : 8,188,966 B2
APPLICATION NO. : 12/232351
DATED : May 29, 2012
INVENTOR(S) : Yong Seok Choi It is certified that error appears in the above-identified patent and that said Letters Patent is hereby corrected as shown below:

On the cover page:

Under the subheading "(73) Assignee:" lines 1-2, delete "Samsung Electronics Co., Ltd., Suwon-Si (KR)" and insert -- Magnachip Semiconductor Ltd., Cheongju-si (KR) --.

Signed and Sealed this
Sixth Day of November, 2012

David J. Kappos

David J. Kappos
*Director of the United States Patent and Trademark Office*